US012595576B2

(12) United States Patent
Thompson et al.

(10) Patent No.: US 12,595,576 B2
(45) Date of Patent: Apr. 7, 2026

(54) ELECTROCHEMICAL REACTOR SYSTEM AND METHOD

(71) Applicant: University of Kentucky Research Foundation, Lexington, KY (US)

(72) Inventors: Jesse G. Thompson, Lexington, KY (US); Kunlei Liu, Lexington, KY (US); Leland Widger, St. Clair, MI (US); Daniel Moreno, Hauppauge, NY (US); Ayokunle Omosebi, Lexington, KY (US); James Landon, Lexington, KY (US)

(73) Assignee: University of Kentucky Research Foundation, Lexington, KY (US)

( * ) Notice: Subject to any disclaimer, the term of this patent is extended or adjusted under 35 U.S.C. 154(b) by 496 days.

(21) Appl. No.: 17/951,895

(22) Filed: Sep. 23, 2022

(65) Prior Publication Data

US 2023/0086140 A1 Mar. 23, 2023

Related U.S. Application Data

(60) Provisional application No. 63/247,751, filed on Sep. 23, 2021.

(51) Int. Cl.

| | |
|---|---|
| ***C25B 9/19*** | (2021.01) |
| ***C25B 3/07*** | (2021.01) |
| ***C25B 3/20*** | (2021.01) |
| ***C25B 3/26*** | (2021.01) |
| ***C25B 9/15*** | (2021.01) |
| ***C25B 13/04*** | (2021.01) |
| ***C25B 15/08*** | (2006.01) |
| *C25B 1/02* | (2006.01) |
| *C25B 1/23* | (2021.01) |

(Continued)

(52) U.S. Cl.

CPC ..... *C25B 9/19* (2021.01); *C25B 3/07* (2021.01); *C25B 3/20* (2021.01); *C25B 3/26* (2021.01); *C25B 9/15* (2021.01); *C25B 13/04* (2013.01); *C25B 15/087* (2021.01); *C25B 1/02* (2013.01); *C25B 1/23* (2021.01); *C25B 1/27* (2021.01); *C25B 1/50* (2021.01)

(58) Field of Classification Search

CPC .... C25B 3/26; C25B 9/19; C25B 3/07; C25B 3/20; C25B 9/15; C25B 13/04; C25B 15/087; C25B 1/02; C25B 1/23; C25B 1/27; C25B 1/50

See application file for complete search history.

(56) References Cited

U.S. PATENT DOCUMENTS

2020/0056298 A1* 2/2020 Voskian ..... C25B 15/08
2023/0407490 A1* 12/2023 Wang ..... C25B 1/04

OTHER PUBLICATIONS

Buddhinie et al. Efficient and Selective Electrochemically Driven Enzyme-Catalyzed Reduction of Carbon Dioxide to Formate using Formate Dehydrogenase and an Artificial Cofactor. Acc. Chem. Res. 2019, 676-685. Feb. 11, 2019. (Year: 2019).*

* cited by examiner

*Primary Examiner* — Ciel P Contreras
(74) *Attorney, Agent, or Firm* — Stites & Harbison PLLC; Warren D. Schickli

(57) ABSTRACT

An electrochemical reactor system adapted for producing a chemical product from a reactant includes (a) separate electrochemical and production cells and (b) a charge carrier compound in a catholyte adapted to effectively decouple the (Continued)

charging of the charge carrier compound in the electrochemical cell with the electrochemical conversion of a reactant to a desired chemical product in the production cell.

10 Claims, 6 Drawing Sheets

(51) Int. Cl.
*C25B 1/27* (2021.01)
*C25B 1/50* (2021.01)

ELECTROCHEMICAL REACTOR SYSTEM AND METHOD

RELATED APPLICATION

This application claims the benefit of U.S. Provisional patent application Ser. No. 63/247,751 filed on Sep. 23, 2021, the full disclosure of which is hereby incorporated by reference.

GOVERNMENT SUPPORT

This invention was made with government support under Grant No. DOE-NETL DE-FE0031720 awarded by the U. S. Department of Energy, National Energy Technology Laboratory and US-China CERC DE-PI0000017. The government has certain rights in the invention.

TECHNICAL FIELD

This document relates generally to an electrochemical reactor system and method that uses a molecular charge carrier compound or compounds to transfer electrochemical equivalents from an electrode-containing charging cell to a separate reactor. That separate reactor contains a catalyst/enzyme that utilizes the transferred charge to electrochemically mediate a reaction.

BACKGROUND

This document describes a dual-cell flow-through electrochemical reactor system and method that uses separate electrochemical and production cells to effectively decouple the charging event in the electrochemical cell from the reaction event in the production cell. Advantageously, this approach serves to (a) protect the catalyst in the production cell from damaging overpotential at the electrode surface and (b) substantially reduces or eliminates solid fouling on the electrode resulting in high ohmic resistance.

The overall system (which may also be called a flow cell or a flow-through fixed bed reactor) is comprised of two reactor cells with two circulated liquid streams. The system is designed to perform simultaneous but decoupled electron transfer steps (charging) where 1) reducing or oxidizing equivalents (electrons) are transferred from an anode, or cathode, to a charge carrier molecule or compound (in the reduction or oxidation cell, respectively) and 2) the reducing equivalents (electrons) or oxidizing equivalents are subsequently transferred by the chemical charge carrier to a product production agent, such as an electrochemical catalyst or enzyme, which utilizes these equivalents to carry out an electrochemical reaction in the production cell. The overall system is designed to convert a charge mediator (charge carrier compound) into a redox state which will readily transfer these equivalents to the product production agent housed in the production cell to allow it to produce a reaction product.

The system and method may be useful in large-scale industrial chemical manufacturing. Specific potential applications include, but are not necessarily limited to, (a) use as an alternative to battery systems for energy storage involving bioreactors/catalysts, (b) photoelectrochemical systems and (c) combined water treatment processes.

SUMMARY

In accordance with the purposes and benefits described herein, an electrochemical reactor system comprises: (a) an electrochemical cell having a cathode compartment and an anode compartment separated by a membrane, (b) a production cell in communication with the cathode compartment, (c) a cathode held in the cathode compartment, (d) an anode held in the anode compartment and (e) a voltage source adapted for applying a voltage potential across the cathode and the anode. The electrochemical reactor system further comprises: (f) a product production agent held in the production cell, (g) a source of the reactant in communication with the electrochemical cell, (h) a catholyte circuit adapted for circulating a catholyte from a catholyte supply through the cathode compartment and then through the production cell and then back to the catholyte supply and (i) an anolyte circuit adapted for circulating an anolyte from an anolyte supply through the anode compartment and back to the anolyte supply.

When the electrochemical reactor system is in operation, (1) a charge carrier compound in the catholyte is reduced from a neutral form to an active redox form in the electrochemical cell at the cathode, (2) protons are generated at the anode, (3) the protons pass through the membrane into the catholyte when a potential is applied across the cathode and the anode, (4) the redox form of the charge carrier compound is circulated to the production cell where charge is transferred to the product production agent to electrochemically convert the reactant to the chemical product and the redox form of the charge carrier compound is converted back to the neutral form, and (5) the neutral form of the charge carrier compound is returned to the catholyte supply.

The cathode may be a carbon-based electrode adapted to facilitate electron transfer and the anode may be a platinum-based electrode. In some embodiments, the anode may be a PtIr on xerogel electrode.

The charge carrier compound may be selected from a group consisting of a viologen, methyl viologen, ethyl viologen, a paraquat, a quinone, a nitrooxide and mixtures thereof capable of charge transfer to the product production agent. The charge carrier compound may have a concentration of between about 0.1 to about 10.0 mM. Where a buffer is included in the catholyte, it may have a higher concentration than the charge carrier compound (e.g. from about 10.0 to about 200.0 mM). A wide range of buffers may be used including, for example, carbonate buffers, such as potassium carbonate, and phosphate buffers, such as sodium phosphate, as well as mixtures thereof.

The anolyte may comprise water or water plus an acid. Useful acids include, but are not necessarily limited to hydrochloric acid and sulfuric acid. The pH of the anolyte may range from about pH 2.0 to about pH 4.0.

The membrane in the electrochemical cell may comprise a cation exchange membrane or a proton permeable membrane as are known in the art.

The product production agent may vary depending upon the particular application and more specifically which reactant is being electrochemically converted to which chemical product. The product production agent generally comprises a catalyst and/or an enzyme adapted for the electrochemical conversion of the reactant to the chemical product.

The electrochemical reactor system has many potential applications for the production of a wide range of chemical products. Useful reactant/product/product production agent combinations include but are in no way limited to carbon dioxide/formic acid/$CO_2$ reductase or formate dehydrogenase, nitrogen/ammonia/nitrogenase, protons/hydrogen/hydrogenase, and methane/methanol/methane monooxygenase.

In accordance with yet another aspect, a method of producing a chemical product from a reactant, comprises the steps of: (1) circulating a catholyte from a catholyte supply through a cathode compartment of an electrochemical cell to a production cell and then back to the catholyte supply, (2) applying a voltage potential across a cathode and an anode of the electrochemical cell to (a) reduce a charge carrier compound in the catholyte from a neutral form to an active redox form, (b) generate protons in an anode compartment of the electrochemical cell and (c) migrate the protons from an anolyte in the anode compartment through a membrane into the catholyte in the cathode compartment, and (3) transferring a charge from the active redox form of the charge carrier compound to a product production agent held in the production cell in order to electrochemically convert (i) the reactant to the chemical product and (ii) the redox form of the charge carrier compound back to the neutral form for return to the catholyte supply.

The method may further include the step of circulating the anolyte from an anolyte supply to the anode compartment and then back to the anolyte supply. The method may further include the step of supplying the reactant to the production cell. The method may further include the step of transferring reducing or oxidizing equivalents from an anode or a cathode to the charge carrier compound in the electrochemical cell and transferring reducing or oxidizing equivalents from the charge carrier compound to the product production agent in the production cell for electrochemical conversion of the reactant to the chemical product.

Still further, a method is provided for producing a chemical product from a reactant. That method comprises the steps of: (1) transferring reducing or oxidizing equivalents from an anode or a cathode to a charge carrier compound in an electrochemical cell, (2) transferring reducing or oxidizing equivalents from the charge carrier compound to a product production agent in a production cell and (3) converting, by electrochemical reaction, the reactant to the chemical product in the production cell using the product production agent.

Still further, the method may include any one or more of the following steps: (a) circulating the charge carrier compound between the electrochemical cell and the production cell, (b) applying a voltage potential across a cathode and an anode of the electrochemical cell to reduce the charge carrier compound from a neutral form to an active redox form and generate protons in an anode compartment of the electrochemical cell, (c) protecting the product production agent from potentially damaging overpotential at the cathode and the anode by holding the product production agent in the production cell separate from the electrochemical cell and (d) using a catalyst or an enzyme as the product production agent.

In the following description, there are shown and described several preferred embodiments of the electrochemical reactor system and the related method of transferring electrochemical equivalents from an electrode-containing charging cell to a separate reactor that contains product production agent (e.g. a catalyst and/or enzyme) that utilizes the transferred charge to electrochemically mediate a reaction. As it should be realized, the electrochemical reactor system and method are capable of other, different embodiments and their several details are capable of modification in various, obvious aspects all without departing from the biomass fuel slurry and method as set forth and described in the following claims. Accordingly, the drawings and descriptions should be regarded as illustrative in nature and not as restrictive.

BRIEF DESCRIPTION OF THE DRAWING FIGURES

The accompanying drawing figures incorporated herein and forming a part of the specification, illustrate several aspects of the electrochemical reactor system and the method and together with the description serve to explain certain principles thereof.

Figure 5A:
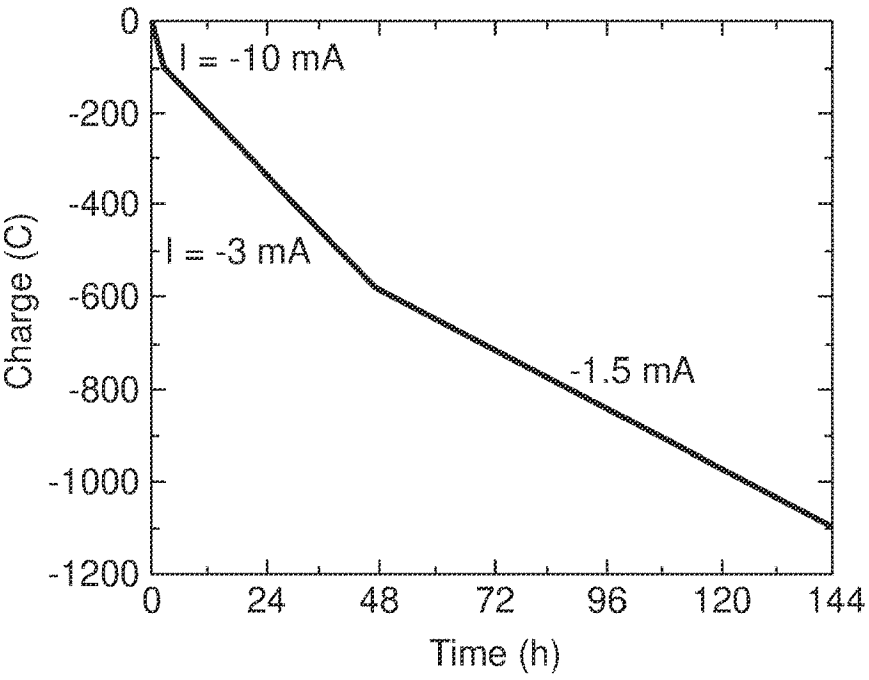
Figure 5B:
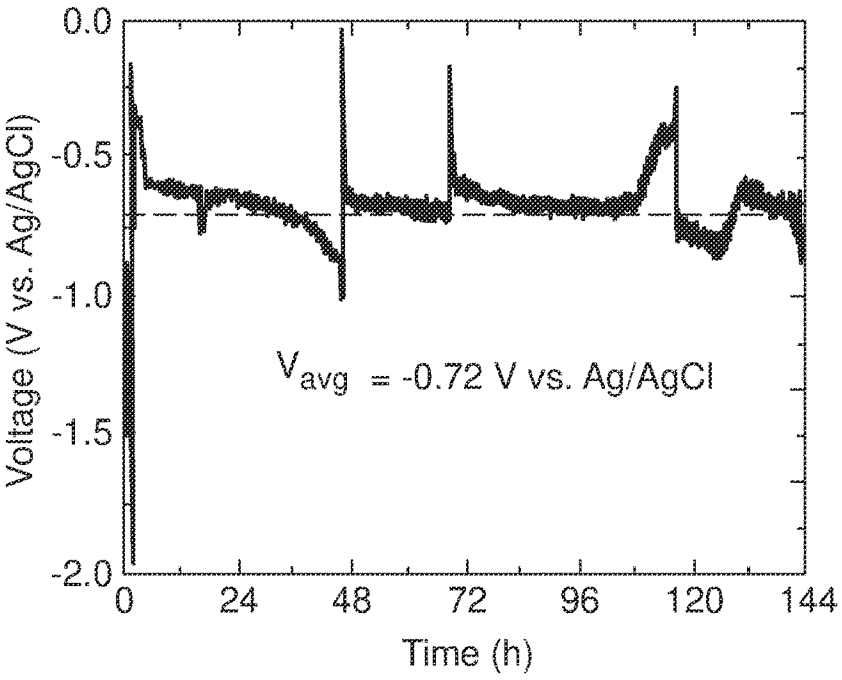

FIGS. 5A and 5B are graphic illustrations of electrochemical results of long term experiment with varying degrees of applied current. FIG. 5A illustrates charge data, with current dictated by the slope of the graph. FIG. 5B illustrates voltage data applied on the cathode.

Figure 6A:
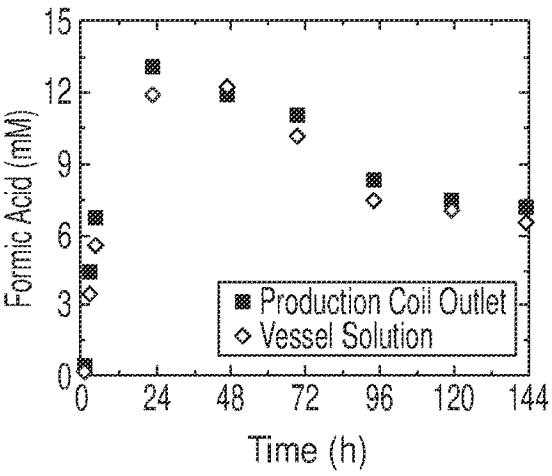
Figure 6B:
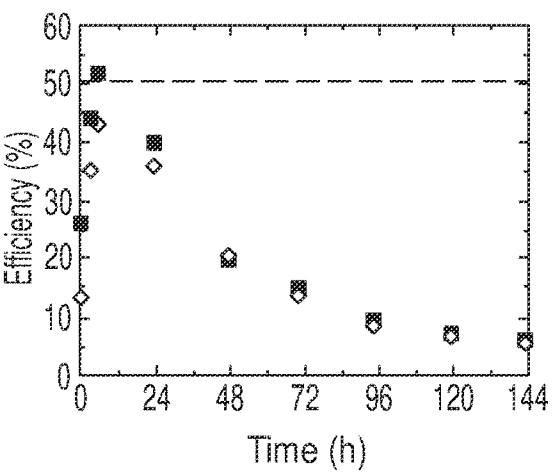
Figure 6C:
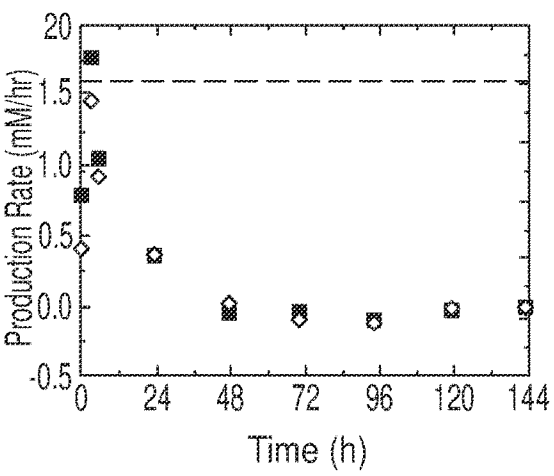

FIGS. 6A-6C are graphic illustrations of the results obtained from IC data for the electrochemical reactor system with data collected at two different locations in the system. FIG. 6A shows formic acid production. FIG. 6B shows efficiency. FIG. 6C shows production rate (mM/hr).

DETAILED DESCRIPTION

Figure 1:
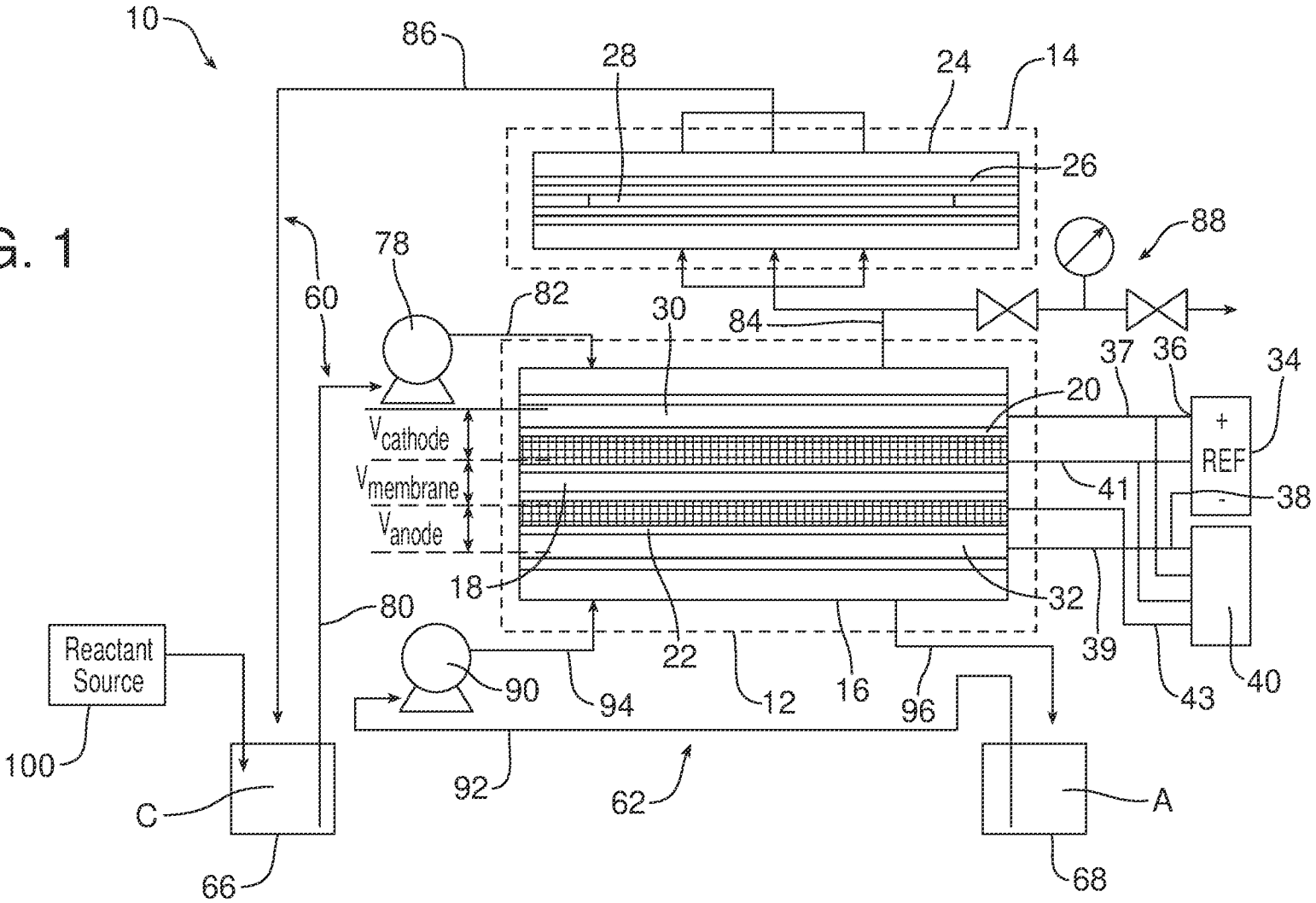
FIG. 1 is a schematic illustration of the electrochemical reactor system including two separate electrochemical and production cells.

Reference is now made to FIG. 1 which schematically illustrates the electrochemical reactor system 10 including an electrochemical cell 12 and a separate, production cell 14. The electrochemical cell 12 includes a first reactor 16 having an internal chamber divided by a membrane 18 into a first compartment 20 and a second compartment 22. The membrane 18 may be a cation exchange membrane or a proton permeable membrane of a type known in the art. The production cell 14 includes a second reactor 24 having an internal chamber 26 holding a product production agent 28 adapted for electrochemically converting a supplied reactant to a desired product. Product production agents 28 include both catalysts and enzymes adapted for the indicated purpose.

In the illustrated embodiment a cathode 30 is held in the first or cathode compartment 20. The cathode 30 may be made from a number of known electrode materials. In the illustrated embodiment, the cathode 30 is a carbon-based electrode which serves to facilitate electron transfer. An anode 32 is held in the second or anode compartment 22. The anode 32 may be made from a number of known materials used in electrode construction. In the illustrated embodiment, the anode 32 is a platinum-based electrode, a PtIr on carbon xerogel electrode or platinum metal on a carbon substrate.

The system 10 also includes a voltage source 34, of a type known in the art, that is adapted to apply a voltage potential across the cathode 30 and the anode 32. More specifically, the positive terminal 36 of the voltage source 34 is connected by a lead 37 to the cathode 30 and the negative terminal 38 of the voltage source is connected by a lead 39 to the anode 32. A data logger 40, also of a type known in the art, may also be provided to log voltage data. Applied currents may generally range from about 2 to about 100 milliamps at between 4 and 6 volts. Lead 41 is connected to the reference electrode. Lead 43 is connected to the data logger 40.

More specifically, the electrochemical cell includes two end plates 42, 44 that may be constructed from stainless steel, aluminum, or other appropriate material. Gaskets 46 sandwich the cathode 30 and gaskets 48 sandwich the anode 32. The gaskets 46 and 48 may be made from polytetrafluoroethylene (PTFE), silicone rubber, or other appropriate electrically insulating material as is known in the art. Gaskets 50 sandwich the membrane 18. The gaskets 50 may be made from polytetrafluoroethylene (PTFE), silicone rubber, or other appropriate electrically insulating material.

A mesh 52, made from a chemical-resistant polypropylene or other appropriate material separates the cathode 30 and its associated gaskets 46 from the membrane 18 and its associated gaskets 50. A mesh 54, also made from polypropylene or other appropriate material separates the anode 32 and its associated gaskets 48 from the membrane 18 and its associated gaskets 50. As will be apparent from the following description, the mesh 52 provides an open and proper flow space for a catholyte C between the cathode 30 and the membrane 18 while the mesh 54 provides an open and proper flow space for an anolyte A between the anode 32 and the membrane 18.

Figure 2:
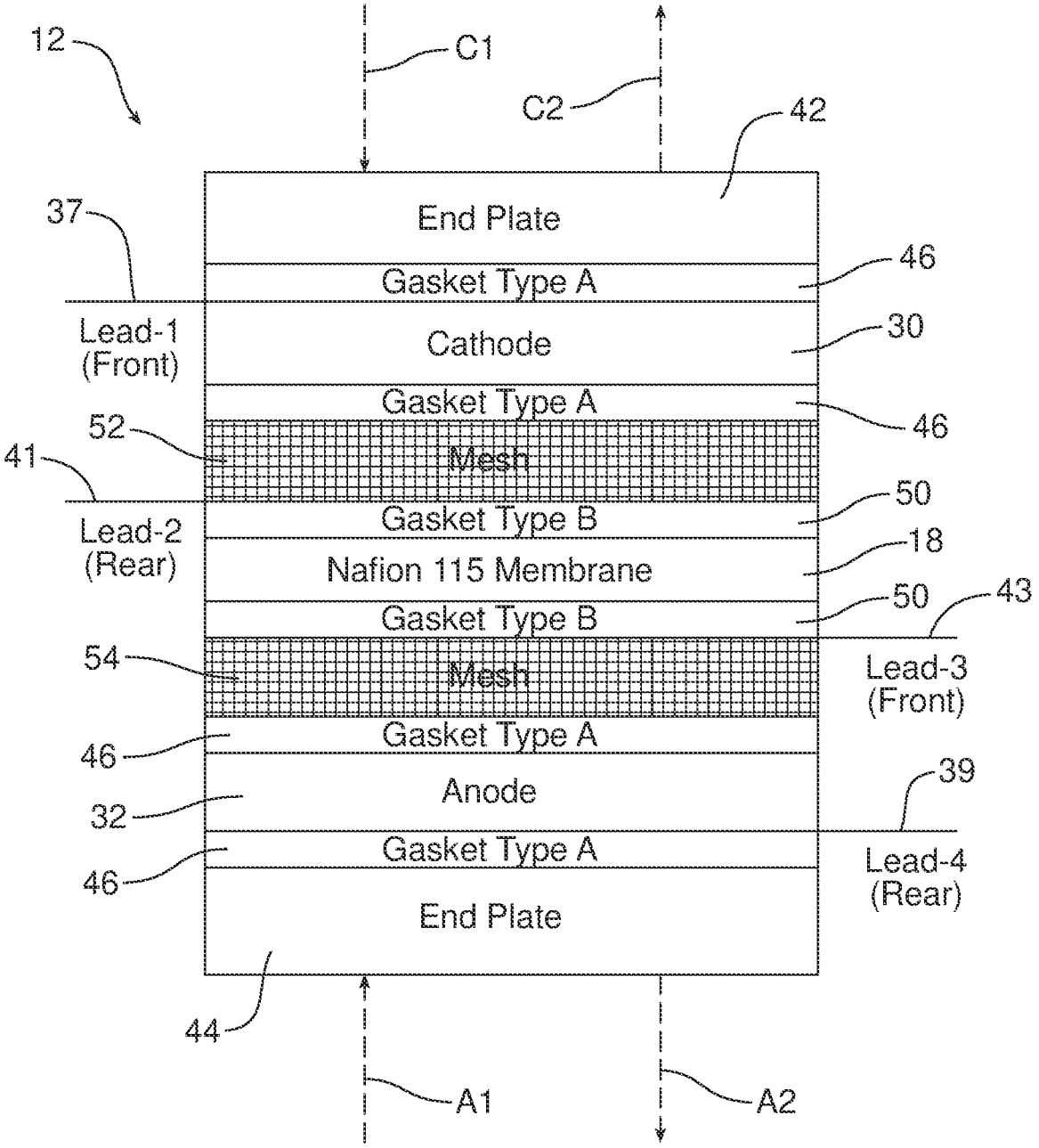
FIG. 2 is a detailed schematic illustration of the electrochemical cell from the electrochemical reactor system illustrated in FIG. 1.

As illustrated in FIG. 2, the gaskets 46 extend between (a) the end plate 42 and the cathode 30 and (b) between the cathode 30 and the mesh 52. The gaskets 48 extend between (a) the end plate 44 and the anode 32 and (b) the anode 32 and the mesh 54. The gaskets 50 extend between the membrane 18 and the two mesh 52, 54.

The system 10 also includes a first circuit, generally designated by reference number 60 and a second circuit, generally designated by reference number 62. The first or catholyte circuit 60 is adapted for circulating the catholyte C from a first electrolyte or catholyte supply 66 through the cathode compartment 20 along the cathode 30 and around and through the mesh 52 and then through the production cell 14 and then back to the catholyte supply. Note particularly the catholyte inlet flow arrow C1 and catholyte outlet flow arrow C2 at the end plate 42 in FIG. 2. The anolyte circuit 62 is adapted for circulating the anolyte A from a second electrolyte or an anolyte supply 68 through the anode compartment 22 and back to the anolyte supply. Note particularly the anolyte inlet flow arrow A1 and the anolyte outlet flow arrow A2 at the end plate 44 in FIG. 2.

More specifically, the first electrolyte or catholyte includes a charge carrier compound and a buffer. The charge carrier compound is adapted to be reduced from a neutral form to an active redox form in the electrochemical cell 12 at the cathode 30 while protons are generated at the anode 32. Charge carrier compounds useful for this purpose include, but are not necessarily limited to a viologen, methyl viologen, ethyl viologen, a paraquat, a quinone, a nitrooxide and mixtures thereof. Buffers useful in the system 10 include, but are not necessarily limited to a carbonate buffer, a phosphate buffer, potassium carbonate, sodium phosphate and mixtures thereof. The concentration of charge carrier compound in the catholyte may range from about 0.1 to about 10.0 mM while the concentration of buffer is higher still (e.g. 10-200 mM).

The anolyte includes water or water plus an acid. Acids used in the anolyte include, but are not necessarily limited to, hydrochloric acid, sulfuric acid and combinations thereof. The pH of the anolyte may range from about pH 2 to about pH 4.

Figure 3:
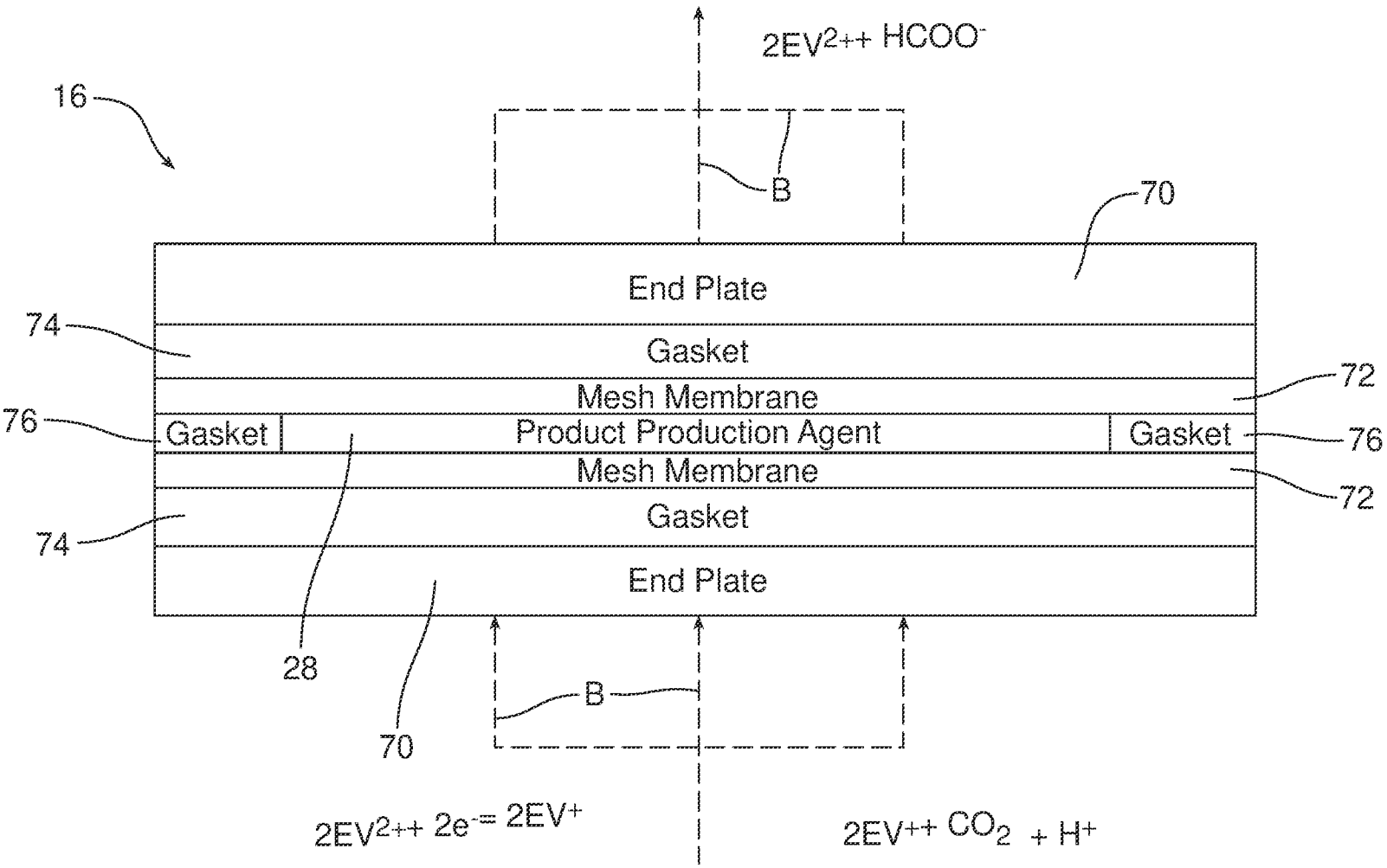
FIG. 3 is a detailed schematic illustration of the production cell from the electrochemical reactor system illustrated in FIG. 1.

As illustrated in FIG. 3, the product production agent 28 is held in the production cell 16 between two end plates 70. Still further, the product production agent 28 may be sandwiched between two mesh membranes 72. Those mesh membranes 72 function to hold the product production agent 28 in place while allowing the catholyte C received from the electrochemical cell 14 to freely flow over and through the product production agent. In one possible embodiment, the mesh membrane may comprise Snyder flat sheet ultrafiltration membranes, 305×305 mm, or chemical-resistant plastic mesh, 121×121 opening size. Of course, it should be appreciated that other appropriate materials may be used for this purpose.

The product production agent can be held in the production cell by several methods, including but not limited to size exclusion, chemical tethering, and physical immobilization. In one iteration the product production agent is held in the production cell due to the small pore size of a mesh membrane and the attachment of catalysts to immobilized agarose beads. Upon immobilization of the agarose beads, the combined agglomerate reaches an average pore size of 150 um, which enables the use of mesh membranes with pore sizes of up to 100 um to accommodate them. This, in lieu of a less porous membrane with a size on the kilodalton scale (75 kDa) catalyst against a 30-50 kDa membrane, eliminates some of the pressure challenges associated with the flow-through of solution, particularly at greater flow rates. Studies conducted on the structural stability of the catalyst inside the production cell led to approximately 95% retention in the membrane over a 24-hour period at various flow rates up to 5 mL/min.

In another iteration chemical/covalent tethering immobilization could include a attaching the product production agent via a chemical bond (covalent, ionic, etc.) as a linker to some fixed structure within the production cell (walls, mesh, etc.). In another iteration physical trapping could include immobilizing the product production agent within a polymer matrix, such that the polymer matrix is permeable to the solvent (like a hydrogel) but the size of the product production agent prevents it from migrating/diffusing through the matrix.

Gaskets 74 are provided between the two mesh membranes 72 and the end plates 70. A further gasket 76 is provided around the product production agent 28 between the two mesh membranes 72. The gaskets 74, 76 function together to define a catholyte flow passageway between the end plates 70 and through the product production agent 28 (note action arrows B in FIG. 3.

Product production agents useful in the production cell 16 include any enzyme or catalyst that will electrochemically convert the starting material reactant to the desired production product. This includes enzymes that use NAD(H)/NADP(H), Fe/S clusters or other electron transfer structures. For example, nitrogenase could be used in the system to convert nitrogen to ammonia. Hydrogenase could be used to convert protons to hydrogen. Methane monooxygenase could be used to convert methane to methanol. Example catalysts include but are in no way limited to formate dehydrogenase, $CO_2$ reductase, carbonic anhydrase for $CO_2$→bicarbonate, carbon monodioxide dehydrogenase (CODH) for $CO_2$→carbon monoxide.

The catholyte circuit 60, for circulating the catholyte C from a catholyte supply 66 through (a) the cathode compartment 20 along the cathode 30 and around and through the mesh 52 and then (b) through the production cell 14 and then (c) back to the catholyte supply, may include a pump 78. More particularly, the pump 78 draws catholyte from the catholyte supply 66 through the first catholyte supply line 80 and then discharges that catholyte through the second catholyte supply line 82 into the cathode compartment 20. There the charge carrier compound is reduced from a neutral form to an active redox form at the cathode 30 and protons are generated at the anode 32.

The protons pass through the membrane 18 into the catholyte when a potential is applied across the cathode 30 and the anode 32. The pump 78 then circulates the redox form of the charge carrier compound through the catholyte transfer line 84 to the production cell 14 where charge is transferred to the product production agent 28 to electrochemically convert the reactant to a new product and the redox form of the charge carrier compound is converted back to the neutral form. Next, the pump 78 circulates the neutral form of the charge carrier compound back to the catholyte supply 66 through the catholyte return line 86. A pressure gage/tranducer and relief valve assembly of a type known in the art and generally designated by reference number 88, ensures that a proper working pressure is maintained in the catholyte circuit 60 at all times.

The anolyte circuit 62, for circulating an anolyte from an anolyte supply through the anode compartment and back to the anolyte supply, may include a pump 90. The pump 90 draws anolyte from the anolyte supply 68 through the first anolyte supply line 92 and then discharges that anolyte through the second anolyte supply line 94 into the anode compartment 22. That anolyte is then returned by the pump 90 through the anolyte return line 96 to the anolyte supply 68 as shown in FIG. 1.

As further illustrated in FIG. 1, the system 10 also includes a source of reactant 100 in communication with the electrochemical cell 12. In the illustrated embodiment, the source of reactant feeds reactant into the catholyte C in the catholyte supply 66. In other embodiments, the reactant may be fed directly into the electrochemical cell 12.

As should be appreciated from the above, the electrochemical reactor system 10 is useful in a method of electrochemically producing a chemical product from a reactant. That method includes the step of circulating a catholyte from a catholyte supply 66 through a cathode compartment 20 of an electrochemical cell 12 to a production cell 16 and then back to the catholyte supply. Further, that method includes the step of applying a voltage potential across the cathode 30 and the anode 32 of the electrochemical cell 12 to (a) reduce a charge carrier compound in the catholyte from a neutral form to an active redox form, (b) generate protons in an anode compartment 22 of the electrochemical cell and (c) migrate the protons from an anolyte in the anode compartment through a membrane 18 into the catholyte in the cathode compartment 20. Still further, the method includes the step of transferring a charge from the active redox form of the charge carrier compound to a product production agent 28 held in the production cell 16 in order to electrochemically convert (i) the reactant to the chemical product and (ii) the redox form of the charge carrier compound back to the neutral form for return to the catholyte supply 66.

In addition, the method includes the step of circulating the anolyte from the anolyte supply 68 to the anode compartment 22 and then back to the anolyte supply by means of the anolyte circuit 62. The method also includes the step of supplying the reactant to the production cell 16 where the product production agent 28 electrochemically converts the reactant to the desired chemical product. Still further, in one or more of the many possible embodiments, the method includes the steps of transferring reducing or oxidizing equivalents from the anode 32 or the cathode 30 to the charge carrier compound in the electrochemical cell 12 and transferring reducing or oxidizing equivalents from the charge carrier compound to the product production agent 28 held in the production cell 16 for electrochemical conversion of the reactant to the chemical product.

The method may also be characterized as including the steps of: (a) transferring reducing or oxidizing equivalents from an anode 32 or a cathode 30 to a charge carrier compound in an electrochemical cell 12, (b) transferring reducing or oxidizing equivalents from the charge carrier compound to a product production agent 28 in a production cell 14 (separate from the electrochemical cell) and (c) converting, by electrochemical reaction, the reactant to the chemical product in the production cell using the product production agent. Further, the method may include the step of circulating the charge carrier compound between the electrochemical cell 12 and the production cell 14 such as by means of the first circuit 60 described above.

In accordance with still another aspect, the method may also include the step of protecting the product production agent 28 from potentially damaging overpotential at the cathode 30 and the anode 32 by holding the product production agent in the production cell 14 separate from the electrochemical cell 12. This effectively decouples the charging of the charge carrier compound with the anode 32 and cathode 30 from the electrochemical conversion of the reactant to the desired chemical product using the product production agent 28 (catalyst or enzyme).

Figure 4:
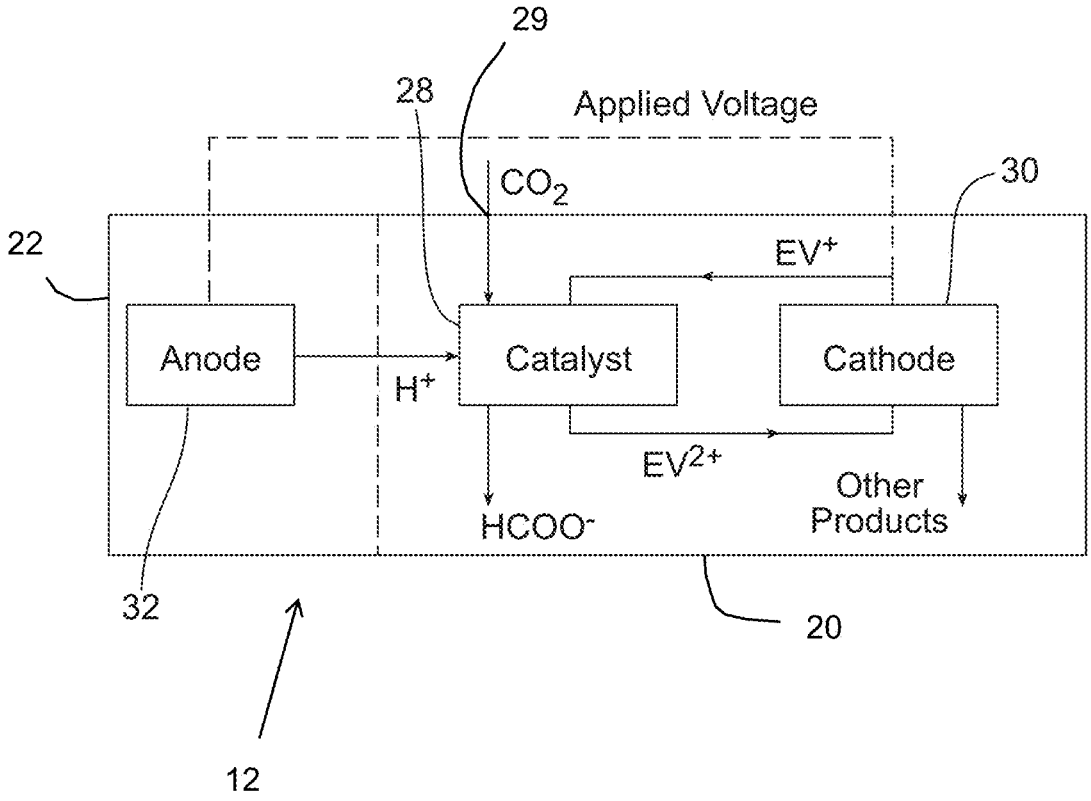
FIG. 4 is a representation of the conversion process for a charge carrier compound (ethyl viologen, EV) used with a catalyst in the production cell to produce a fuel (formate, $HCOO^-$) after reacting with a reactant (carbon dioxide, $CO_2$) and protons from the electrochemical cell.

In one of the many possible embodiments of the system 10 and as schematically depicted in FIG. 4, the reactant is carbon dioxide, which is delivered to the cathode compartment 20 of the electrochemical cell 12 at the carbon dioxide inlet 29, and the product to be produced from that carbon dioxide is formic acid (i.e. carbon dioxide is reduced to formic acid). The charge carrier compound used in this embodiment is ethyl viologen (EV). As illustrated, (a) the charge carrier compound is reduced from a neutral form to an active redox form in the electrochemical cell 12 at the cathode 30 and protons are generated at the anode 32, (b) the protons pass through the membrane 18 into the catholyte when a potential is applied across the cathode and the anode, (c) the redox form of the charge carrier compound is circulated to the production cell 16 where charge is transferred to the product production agent 28 to convert the carbon dioxide to formic acid and the redox form of the charge carrier compound is converted back to the neutral form, and (d) the neutral form of the charge carrier compound is returned to the catholyte supply 66.

FIG. 5A is a graph plotting charge versus time and FIG. 5B is a graph plotting voltage versus time for use of the electrochemical reactor system 10 and related method in converting carbon dioxide to formic acid. This indicates that, typically, total voltages in the cell should not exceed 6 V. If 8 V are exceeded, then the stability of a purely platinum-based anode in the reduction cell may begin to become compromised.

FIGS. 6A-6C are graphs illustrating results obtained when using the electrochemical reactor system 10 described above to convert carbon dioxide to formic acid. The results demonstrated that the catalyst was successfully able to convert at least the indicated % of the input energy into formic acid, over the indicated time span. The cell will be able to continue producing products via reduction so long as pH, stability, and retention of enzyme in the production cell can be retained. This demonstrates why the selection of buffer to regulate pH, electrode materials, and flow parameter selection are important to bolster the long-term production of value-added products in a batch cell reactor.

Each of the following terms written in singular grammatical form: "a", "an", and "the", as used herein, means "at least one", or "one or more". Use of the phrase "One or more" herein does not alter this intended meaning of "a", "an", or "the". Accordingly, the terms "a", "an", and "the", as used herein, may also refer to, and encompass, a plurality of the stated entity or object, unless otherwise specifically defined or stated herein, or, unless the context clearly dictates otherwise. For example, the phrase: "an enzyme", as used herein, may also refer to, and encompass, a plurality of enzymes.

Each of the following terms: "includes", "including", "has", "having", "comprises", and "comprising", and, their linguistic/grammatical variants, derivatives, or/and conjugates, as used herein, means "including, but not limited to", and is to be taken as specifying the stated component(s), feature(s), characteristic(s), parameter(s), integer(s), or step(s), and does not preclude addition of one or more additional component(s), feature(s), characteristic(s), parameter(s), integer(s), step(s), or groups thereof.

The phrase "consisting of", as used herein, is closed-ended and excludes any element, step, or ingredient not specifically mentioned. The phrase "consisting essentially of", as used herein, is a semi-closed term indicating that an item is limited to the components specified and those that do not materially affect the basic and novel characteristic(s) of what is specified.

Terms of approximation, such as the terms about, substantially, approximately, etc., as used herein, refers to ±10% of the stated numerical value.

Although the electrochemical reactor system 10 and related method of this disclosure have been illustratively described and presented by way of specific exemplary embodiments, and examples thereof, it is evident that many alternatives, modifications, or/and variations, thereof, will be apparent to those skilled in the art. For example, in the illustrated embodiment, the charging compartment is the cathode and the production compartment is the anode. That may be reversed in some embodiments. Thus, the first or charging compartment may include the anode and an anolyte and charge carrier compound may be circulated through the first circuit while the second or production compartment may include the cathode and a catholyte may be circulated through the second circuit. Accordingly, it is intended that all such alternatives, modifications, or/and variations, fall within the spirit of, and are encompassed by, the broad scope of the appended claims.

What is claimed:

1. An electrochemical reactor system adapted for producing a chemical product from a reactant, comprising:

an electrochemical cell having (a) a carbon dioxide inlet, and (b) a first compartment and a second compartment separated by a membrane;

a production cell in communication with the first compartment;

a cathode held in one of the first compartment and the second compartment;

an anode held in the other of the first compartment and the second compartment;

a voltage source adapted for applying a voltage potential across the cathode and the anode;

a product production agent held in the production cell;

a source of the reactant in communication with the electrochemical cell;

a first circuit adapted for circulating a first electrolyte from a first electrolyte supply through the first compartment and then through the production cell and then back to the first electrolyte supply wherein the first electrolyte includes a charge carrier compound; and a second circuit adapted for circulating a second electrolyte from a second electrolyte supply through the second compartment and back to the second electrolyte supply;

wherein (a) the charge carrier compound is reduced from a neutral form to an active redox form and protons are generated in the electrochemical cell (b) the redox form of the charge carrier compound is circulated to the production cell where charge is transferred to the product production agent to convert the reactant to the chemical product and the redox form of the charge carrier compound is converted back to the neutral form, (c) the neutral form of the charge carrier compound is returned to the first electrolyte supply and (d) the reactant/product/product production agent combinations consist of carbon dioxide/formic acid/carbon dioxide reductase, and carbon dioxide/formate/formate dehydrogenase.

2. The electrochemical reactor system of claim 1, wherein the cathode is a carbon-based electrode adapted to facilitate electron transfer and the anode is a platinum-based electrode.

3. The electrochemical reactor system of claim 1, wherein the cathode is in the first compartment and the anode is in the second compartment and protons generated at the anode in the second compartment pass through the membrane into the first electrolyte when a potential is applied across the cathode and the anode.

4. The electrochemical reactor system of claim 1, wherein the charge carrier compound is selected from a group consisting of a viologen, methyl viologen, ethyl viologen, a paraquat, a quinone, a nitrooxide and mixtures thereof capable of charge transfer to the product production agent.

5. The electrochemical reactor system of claim 1, wherein the product production agent is selected from a group of a catalyst adapted for electrochemically producing the product from the reactant, an enzyme adapted for electrochemically producing the product from the reactant, and combinations thereof.

6. The electrochemical reactor system of claim 1, wherein the membrane is a cation exchange membrane.

7. The electrochemical reactor system of claim 1, wherein the membrane is a proton permeable membrane.

8. The electrochemical reactor system of claim 1, wherein the second electrolyte is an anolyte selected from a group consisting of water or water plus an acid.

9. The electrochemical reactor system of claim 8, wherein the anolyte has a pH of between about pH 2 and about pH 4.

10. The electrochemical reactor system of claim 1, wherein the first electrolyte is a catholyte including a buffer and the buffer is selected from a carbonate buffer, a phosphate buffer, potassium carbonate, sodium phosphate and mixtures thereof.

* * * * *